United States Patent [19]

Nauta

[11] 4,114,231

[45] Sep. 19, 1978

[54] MOTOR VENTILATION SYSTEM FOR WET/DRY VACUUM CLEANER

[76] Inventor: Jelle G. Nauta, R.R. #4, Stouffville, Ontario, Canada

[21] Appl. No.: 774,317

[22] Filed: Mar. 4, 1977

[51] Int. Cl.[2] ..... A47L 5/00

[52] U.S. Cl. ..... 15/413; 15/321; 15/353

[58] Field of Search ..... 15/412, 413, 353, 327 D, 15/321; 417/366, 367, 368; 310/58

[56] References Cited

U.S. PATENT DOCUMENTS

| | | | |
|---|---|---|---|
| 2,534,808 | 12/1950 | Bevington et al. | 15/353 X |
| 2,884,185 | 4/1959 | Dolan | 15/413 X |
| 2,909,800 | 10/1959 | Grindle et al. | 15/321 |
| 3,780,397 | 12/1973 | Harbeck et al. | 15/413 |
| 3,815,172 | 6/1974 | Fromknecht et al. | 15/413 |

*Primary Examiner*—Christopher K. Moore

*Attorney, Agent, or Firm*—Edward H. Oldham

[57] ABSTRACT

This invention relates to an air flow system for a vacuum cleaner which, because of the nature of the machine, must be able to operate in wet or damp environments without the ingestion of water into the motor. The housing for the motor is of a bulbous shape manufactured of an insulating material and is arranged to have a bulbous shaped insulating cap fitted on the housing in a spaced apart relationship, such that two air flow channels are produced between the housing and cap by a pair of rib structures integrally cast in said housing structure. Air is drawn into the bottom of the cap and moves upwardly between housing and cap, passes through the housing and through the motor fan, through the motor to provide the necessary cooling and thence is expelled to atmosphere by passage out of ports in the housing to pass into another section of the housing-cap structure.

4 Claims, 5 Drawing Figures

MOTOR VENTILATION SYSTEM FOR WET/DRY VACUUM CLEANER

BACKGROUND OF THE INVENTION

By their very nature, wet/dry vacuum cleaners require powerful high speed motors to drive the vacuum producing air pump. Generally, large amounts of cooling air are required to keep the temperature of the motor within suitable operating temperature limits, and for the most part, little attention has been placed on the movement of air through the motor cooling ducts, with a view to cooling the motor in the presence of water spillage at or near the motor housing. Motors driving the air pumps of this class of vacuum cleaner, that is wet/dry vacuum cleaners, may be located in a variety of locations with respect to the soil containment vessel. Some models place the motor below the containment vessel, such that the motor is particularly vulnerable to the ingress of water or other cleaning liquids into the ventilation system of the motor.

SUMMARY OF THE INVENTION

This invention seeks to provide ventilation for a motor driving an air pump on a wet/dry vacuum cleaner which is located above the soil containment vessel. The motor and air pump share a common shaft and the same containment housing, although an interior wall is provided in the housing to separate the air pump from the motor, the common shaft passing through this interior wall. The motor/fan housing is of a bulbous shape and has a pair of ribbed members projecting therefrom to subsequently define the ventilation air flow passages for cooling air. A cap, which too is of a bulbous shape, is subsequently fitted onto the motor/fan housing, such that the ribbed members maintain a predetermined space between the cap and housing.

The ribbed members serve to divide the space between the cap and housing into two separate air passages, one for cooling air entering the motor and the other for the discharge of heated air to atmosphere. The intake air is drawn in under the cap and must pass upwardly a considerable distance to the top of the motor housing before being ducted downwardly into the housing into the interior of the motor, where it is heated and subsequently passed through a set of exhaust ports in the motor housing under the cap and downwardly in the exhaust duct defined by the ribbed members to exit at the bottom of the cap member to atmosphere.

DESCRIPTION OF THE PREFERRED EMBODIMENT OF THE INVENTION

Figure 1:
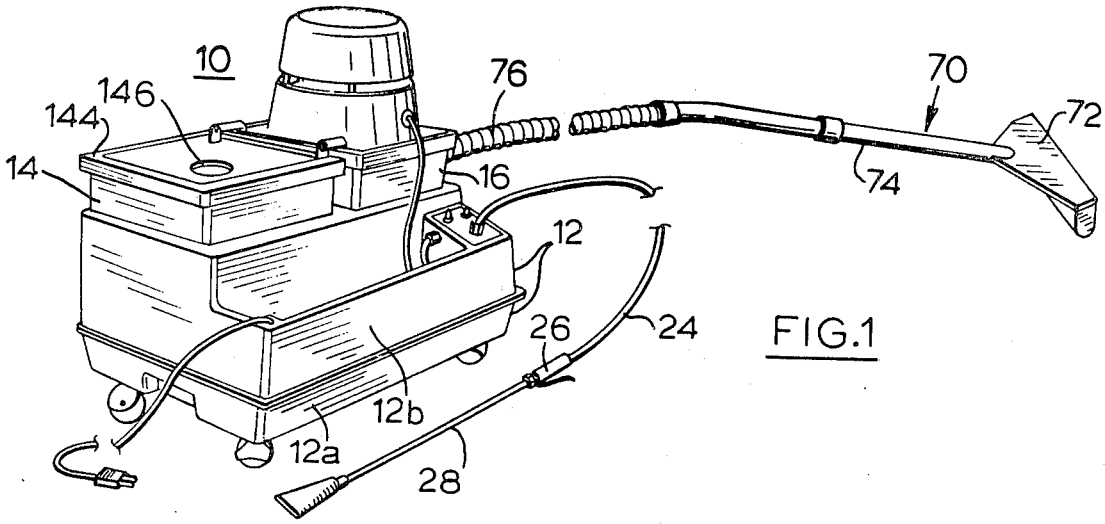
FIG. 1 is a perspective view of the vacuum cleaning machine, showing the general nature of and relationships of the various parts making up the machine.

Referring now to FIG. 1, an electric wet vacuum cleaning machine 10 is illustrated. The machine essentially comprises a wagon body 12 shown mounted on 4 caster wheels for ease of transport. The wagon 12 comprises 2 parts, a lower base portion 12*a* and an upper mating part 12*b* (see FIG. 2). The wagon serves to carry the twin containers 14 and 16.

Container 14 is filled with a liquid cleaning solution, which is expected to be a water-detergent mixture. If desired, the liquid cleaning solution may be heated externally of the cleaning machine and placed in the container or the solution may be used unheated. Although this description does not include it, provision may be made to provide heat for the cleaning solution in situ in the wagon 12 by means of an electrical heater or some other suitable type of heater.

The cleaning solution in container 14 is carried away from the container 14 by means of adapter 18 to which hose 20 is secured. Hose 20 is connected to pump 22 which is part of an integral pump motor combination. The outlet hose 24 is connected to control valve 26 which is ultimately connected to Sprayer wand 28.

Container 14 is shown in the illustrated embodiment as being integral with upper part of wagon 12. It is expected that the complete wagon assembly 12 will be preferably composed of a high impact molded plastic material. This has the advantage of being a good heat and electrical insulator.

Vacuum container 16 is also preferably fabricated from a high impact molded plastic material. The container 16 is covered by a composite sealing lid assembly 30 which sealedly covers container 16 and houses the air pump and motor which provides vacuum for the machine.

Figure 4:
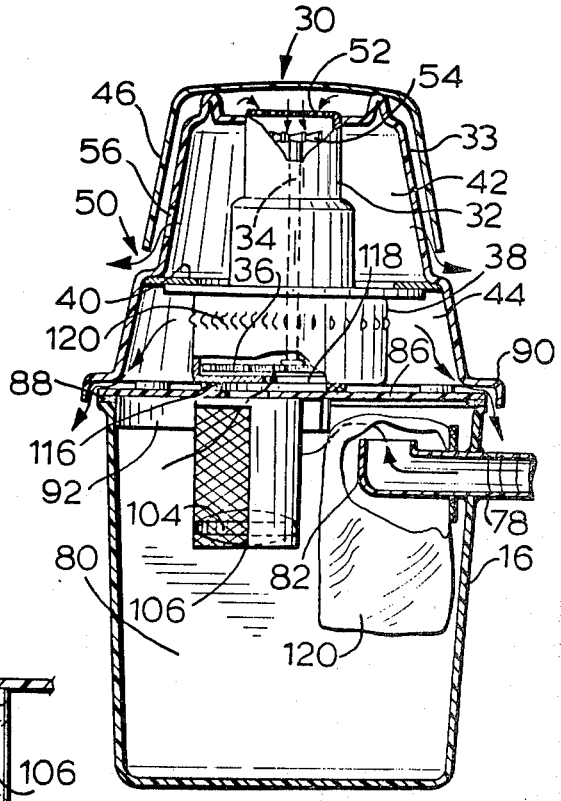
FIG. 4 is a sectional view of the machine shown in FIG. 3.
Figure 5:
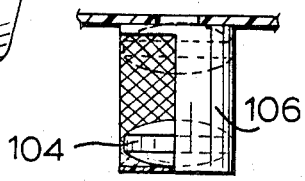
FIG. 5 is an enlarged illustration of the captive floating "pancake" assembly of FIG. 4.
Figure 2:
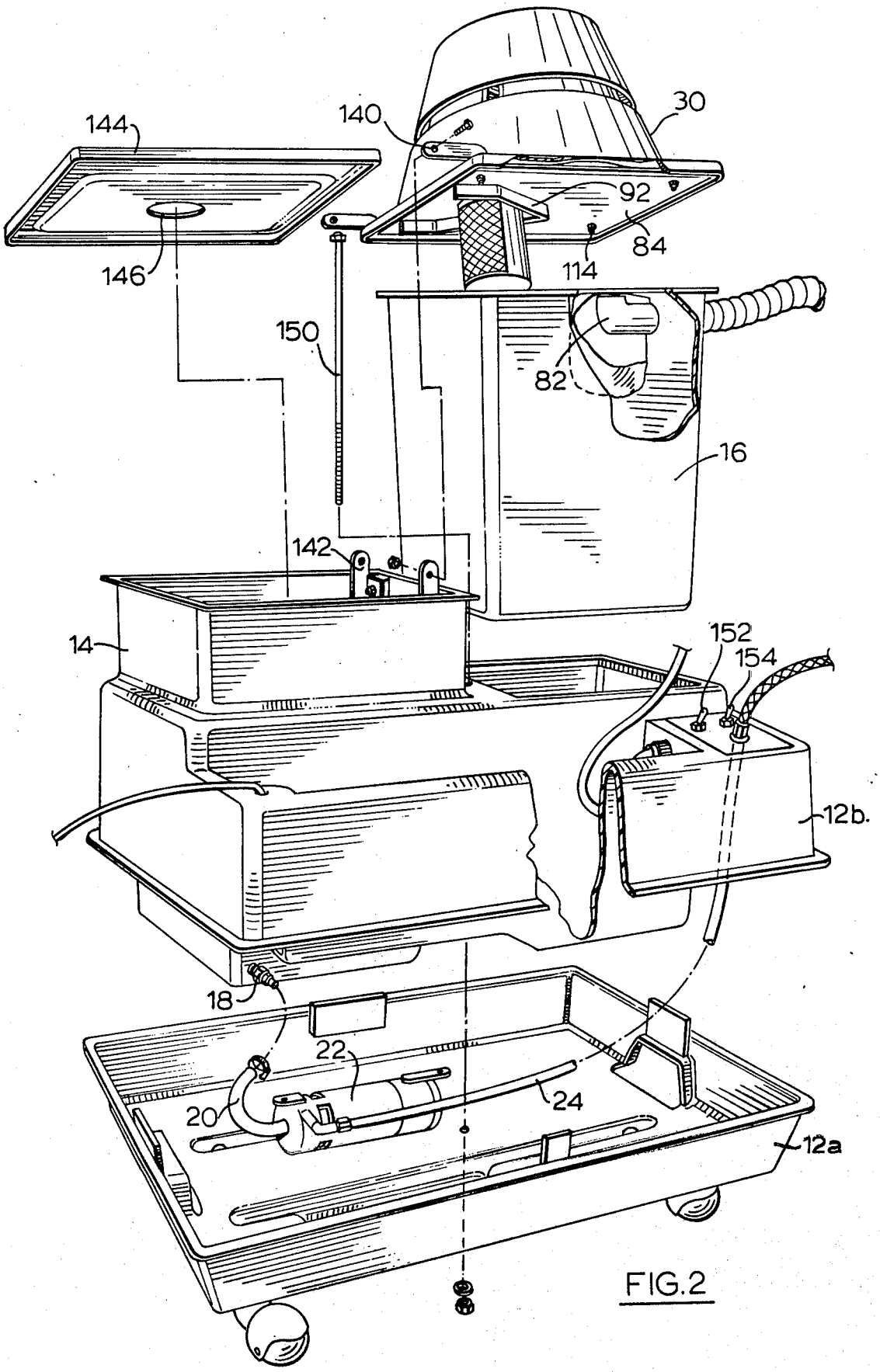
FIG. 2 is an enlarged exploded partial perspective view providing a general overall view of the vacuum cleaner.

Examining the lid assembly in greater detail, as shown in FIGS. 2 and 4, it will be seen that an electric motor 32 is mounted therein in top most housing 33. Mounted in the same lid assembly and in the lower part of housing 33 and on the same shaft 34 is centrifugal fan or air pump 36. Fan 36 is mounted to rotate in housing 38.

Lid 30 is provided with an interior flanged wall 40 which provides a mounting surface for housing 38 of the fan assembly. Housing 38 is fastened in any suitable manner to wall 40 by screws or rivets etc., as long as housing 38 and wall 40 are in a sealed relationship. This is necessary to keep any foreign material from passing from chamber 44 to 42. It might also be mentioned here that the particular motor and fan assembly illustrated in the drawings and preferred for this application includes in its construction, a sealing member between the fan or impeller compartment 38 and the motor housing 32. Although the specific construction of the sealing member will not be described in this application, these seals are well known and comprise generally a non metallic washer assembly mounted on the dividing wall to mate with the rotating shaft.

Figure 3:
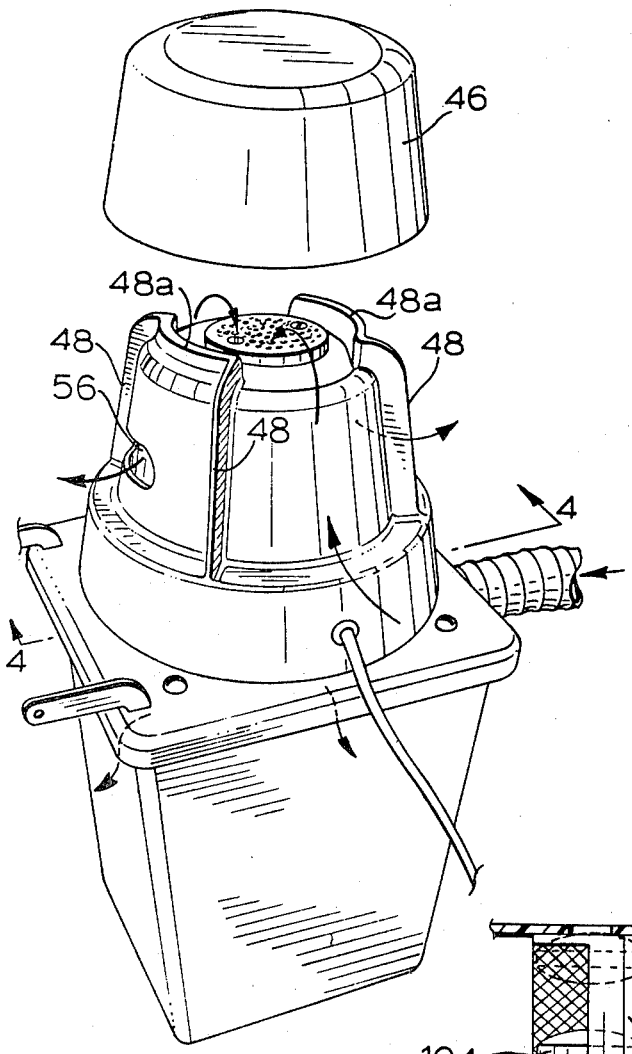
FIG. 3 is a partial view of the machine, showing only the vacuum producing machinery, the motor and containment vessel.

The motor compartment 42 is capped by a special cap 46 of a bulbous shape which is arranged to fit over rib members 48 as best shown in FIG. 3. It will immediately be seen in FIG. 4 that when cap 46 is in its permanent functioning position, a space 50 is left between the lower lip of cap 46 and housing 33. Cap 46 may be fastened to housing 33 by means of suitable adhesive or other fastening means such as screws, rivets etc., as long as this cap is securely held in place.

Cap 46 performs a most important function to direct the cooling air for motor 32, whilst preventing the ingress of water droplets to the motor itself, whilst permitting air to enter the motor compartment. Air is permitted to enter a pair of opposing compartments formed by housing 33, ribs 48 and cap 46, through opening 50. The cooling air must then travel a substantial distance up the compartment so formed to pass through openings 52 in the top of motor housing 32. The air thence passes through motor fan 54 and through the passages provided in the motor housing to cool the motor itself. The air so heated passes out through a series of holes (not shown) in housing 32 and passes into space 42 in housing 33. From space 42, the heated air passes through apertures 56 into the space provided between cap 46 and housing 33 between ribs 48. It is noted that ribs 48 serve to isolate the two inlet compartments from the compartments carrying the heated exhaust air.

It will be noted that cap 46 serves to protect the motor from the ingress of moisture by its size and location on the housing 33. It is to be expected that in the environment in which this machine will be used, that there is a substantial risk that water will be spilled over the motor vacuum assembly 30. In this event, cap 46 will serve to deflect any water so spilled down over the sides of cap 46. Spaces 50 are designed to be large enough so that in the areas of the intake air to the motor, the velocity of the air rushing into the motor fan compartment will not be sufficient to carry any of the water droplets falling from the lower lip of cap 46 over spaces 50, up into apertures 52 and into the motor itself.

It might be mentioned here that rib extensions 48*a* are formed on the top of housing 33, which are formed integrally with ribs 48 so as to complete the isolation of the inlet and exhaust compartments beneath cap 46. Because of the seal between the motor compartment and the fan compartment and the method of sealing the housing 38 to wall 40, all the exhaust air from the motor compartment must be discharged through apertures 56 to atmosphere. Similarly, none of the air in chamber 44 is permitted to pass into space 42 because of the aforementioned description.

The air flow path through the vacuum pump assembly will now be described. Referring to FIG. 1, a wand assembly 70 is illustrated comprising an appliance tool 72 mounted on the hollow tubular wand 74. Wand 74 is connected to a flexible hollow tube 76 which subsequently is fitted to adapter 48, which terminates in the space 80 provided in container 16 in a right angled elbow 82. Air carrying soil and liquid detergent/soil mixture is drawn through tool 72 into tube 74, tubing 76 into member 78 and thence through elbow 82 into space 80 in container 16. The location of member 78 in container 16 is quite important. The elbow member 78 is located near the top of container 16 for several reasons. Firstly, container 16 will no doubt be filled to capacity on occasion and the liquid in the chamber 16 will tend to run out the member 78 if it is located too far down the side of the container 16 if the motor 32 driving the vacuum pump is shut off when container 16 is full.

Elbow member 78 also serves to deflect the air stream exiting therefrom up onto the lower surface 84 of lid assembly 30 in such a manner that the air is separated from the liquid detergent/soil mixture, such that the liquid mixture is not drawn into the vacuum pump. Also, since the air from the hose is expelled upwardly toward surface 84, any tendency to cause turbulence at the liquid surface below is avoided. Such turbulence at the water surface, can set up critical wave action under certain circumstances, resulting in ingestion of droplets of the liquid/soil mixture into the air pump.

Member 30 is provided with a substantially flat sealing member 86 which extends substantially over the complete lower opening of lid member 30. Member 86 is provided with a seal 88 which is located between member 86 and the top lid of container 16.

Member 86 is bolted to assembly 30 in such a manner that a space is provided between member 86 and the lip portion 90 of lid assembly 30. This is provided by a series of raised rib portions on the upper surface of member 86 which engage lip portion 90.

Member 86 is provided with a "Vee" shaped abutment 92 on the lower surface 84 thereof (see FIG. 2). The abutment 92 is of such depth that the lower surface of the abutment 92 is parallel to and only slightly above the opening surface of elbow member 78.

Situated between the legs of the "Vee" shaped abutment 92 is a semicircular boss 106 which also extends downwardly from surface 84. The forward half of the circumference of boss 106 is solid and impervious to air flow, thus acts as an additional baffle and extends downwardly to a greater extent than the rearward semicircular portion. A wire mesh filter screen completes the rearward portion of boss 106 facing to the open end of the "Vee". Note the shallow boss on the rearward semicircular portion between the screen and surface 84. The resulting structure is such as to provide a circular container with a solid bottom formed in such a manner as to captivate "pancake" shaped member 104 therein, in such a manner that member 104 may freely move up and down, but is constrained from any substantial lateral motion. "Pancake" shaped member 104 is made from a material such that it will float in water. In the center of boss 106, an aperture 108 is provided to allow passage of air from compartment 80 into the vacuum pump intake 110.

Lid member 86 is pulled by fastening members 114 into engagement with lip 90 and sealing engagement with the lower surface of housing 38. A suitable sealing member 116 is provided for this function. Aperture 108 is in communication with aperture 118 in the lower surface of fan housing 38 which is the intake for the vacuum pump assembly. From aperture 118, air is drawn into fan impeller 36 and is subsequently expelled through a series of apertures 120 in housing 38. Exhaust air passes into space 44 and exits through space provided between lip 90 of housing 33 and member 86.

The air/liquid mix drawn into chamber 80 passes from elbow member 78 and deflects upwardly, such that the liquid droplets deposit on lower surface 84 of member 86, immediately above the opening in member 78.

It is at this location that substantial separation of the air/liquid mixture takes place, with the air taking a rather circuitous route from the exit aperture in member 78, up against surface 84, past abutment member 92 through screen 106, through aperture 108 and thence into the vacuum pump, out apertures 120, into space 44, and thence out through the space provided between lip 90 and member 86. The space provided for allowing the discharge air from the vacuum pump extends virtually the entire distance around the periphery of lid member 30 immediately below lip 90. This assures plenty of area for the entire discharge orifice and consequently quietens the overall operation of the machine.

During usage of the machine, container 16 gradually fills with the liquid/soil residue, whilst air (the carrier) passes through the machine. As the level of the liquid/-soil mixture rises, "Pancake" shaped member 104 is floated upwards in its cage assembly 102 until the rush of air past the "Pancake" shaped member 104 raises it to maximum height with the subsequent blockage of aperture 108. No further passage of air through the machine is permitted in this condition and further vacuuming may be resumed when container 16 has been emptied.

In instances where the machine is intended to be employed as a dry vacuuming machine only, a paper or cloth filter bag 120 may be placed over elbow member 82. This prevents the passage of foreign material into the fan housing 38 and vacuum cleaning proceeds as it would with a standard dry vacuum cleaner.

In operation, lid member 30 is hinged at 140 to stationary members 142 so that member 30 may be raised and pivoted over member 14 to allow container 16 to be removed from the wagon 12. Also, a cover 144 is provided for container 14. This cover will remain in place at all times and the liquid detergent solution will be placed in container 14 by means of aperture 146 in the lid 144.

The two wagon sections 12*a* and 12*b* are preferably held together by a bolt or other fastening means 150 so as to enable swift disassembly of the wagon for repair or maintenance procedures.

A pair of switches 152, 154 are provided to enable operation of the vacuum motor 32 and the liquid pump 22 separately, for more versatile machine operation, i.e. the pump need not operate when only dry vacuuming.

The wand 70 and sprayer 28 may be physically coupled together for most wet cleaning operations to enable simultaneous spraying and wet pickup vacuuming.

Although this application does not describe it, an electrical heating element may be employed to heat the liquid in the container 14. The power required for this feature must be limited to 600 watts maximum as only a limited amount of power may be drawn from the standard 115 volt domestic supply.

An important feature of this machine is that it will draw no more than 10 amperes from the standard 115 volt domestic supply, as opposed to other devices of this nature which draw up to 15 amperes and even more, thus consuming all of the available power from a standard domestic 15 ampere circuit. This means that 5 amperes of current (approximately 600 watts) are available for lighting the work area so that the operator may have better visibility when little or no natural light is available.

The embodiments of the invention in which an exclusive property or privilege is claimed are defined as follows:

1. A housing assembly for a vacuum cleaner motor-vacuum pump assembly comprising a substantially bulbous housing containing said motor-vacuum pump assembly, said housing assembly having a series of inlet ports in the top surface thereof, a matching cap for said bulbous housing, said cap fitting over and being spaced from said housing by a ribbed structure assembly, said cap and housing having a plurality of openings formed by said cap and said housing at the base of said cap, said openings forming separated inlet and discharge openings for cooling air for the motor of said motor-vacuum pump assembly, said ribbed structure serving to form air flow passages for air flowing in the space between said cap and said housing, said ribbed structure serving to form a plurality of isolated inlet and discharge passages therein so that air flowing into any inlet passage must flow upwardly a substantial distance between said housing and said cap before entering said housing through said inlet ports, said motor-vacuum pump assembly having a fan for moving cooling air through said motor and housing, said air passing through the motor of said motor-vacuum pump assembly to remove heat therefrom, said cooling air passing from said motor into a discharge passage in the space between said cap and said housing and thence to atmosphere through said discharge openings.

2. A housing assembly for a vacuum cleaning machine comprising a substantially bulbous housing containing a motor-air pump assembly, a matching cap for said bulbous housing, said motor of said motor-air pump assembly being provided with fan means for circulating cooling air around and through said motor, said housing having at least a pair of spaced apart rib members projecting from the surface of said housing and integrally joined to said housing, said housing having at least one cooling air inlet port in the uppermost surface of said housing, and at least one cooling air outlet port in said housing at a point below said inlet port, said matching cap fitting on said housing in a predetermined spaced relationship, said rib members forming at least a pair of isolated air conduit passages for said cooling air, such that the inlet cooling air must travel up a substantial distance in a first air conduit passage between cap and housing before entrance to said inlet port is attained, said outlet port exhausting said cooling air into a second air conduit passage in the space between said cap and said housing in such a manner that the exhaust air must travel in a downward direction before escaping from under said cap to atmosphere.

3. A housing as defined in claim 1 wherein said bulbous housing is of substantially frustoconical shape, and said cap is also of substantially frustoconical shape.

4. A housing as defined in claim 1 wherein said housing is of a stepped frustoconical shape, substantially similar in shape to that of an inverted flower pot, such that the outer surface undergoes a stepped change in diameter at approximately the midpoint between the top and bottom of said housing, a cap of substantially frustoconical shape also fitting onto said housing in such a manner as to form a substantially continuous frustoconical surface with said housing, there being a small space between the lower lip of said cap, and said stepped change in diameter of said housing to allow for the ingress and egress of cooling air between said cap and housing.

* * * * *